US007305959B2

(12) United States Patent
Letourneau et al.

(10) Patent No.: US 7,305,959 B2
(45) **Date of Patent: *Dec. 11, 2007**

(54) INTAKE MANIFOLD WITH LOW CHATTER SHAFT SYSTEM

(75) Inventors: Mark Letourneau, Dover Centre (CA); John Mammarella, Windsor (CA)

(73) Assignee: MAHLE Technology, Inc., Farmington Hills, MI (US)

( * ) Notice: Subject to any disclaimer, the term of this patent is extended or adjusted under 35 U.S.C. 154(b) by 49 days.

This patent is subject to a terminal disclaimer.

(21) Appl. No.: 11/185,670

(22) Filed: Jul. 20, 2005

(65) Prior Publication Data

US 2007/0017469 A1 Jan. 25, 2007

(51) Int. Cl.
*F02M 35/10* (2006.01)

(52) U.S. Cl. ..... 123/184.38; 123/184.21; 123/336

(58) Field of Classification Search ..... 123/184.38, 123/184.21, 336, 337
See application file for complete search history.

(56) References Cited

U.S. PATENT DOCUMENTS 4,805,920 A * 2/1989 Gavin ..... 277/606
4,840,146 A * 6/1989 Yanagisawa et al. ..... 123/336
5,341,773 A * 8/1994 Schulte et al. ..... 123/184.61
6,217,627 B1 * 4/2001 Vyskocil et al. ..... 55/492
6,896,568 B2 * 5/2005 Matsuda ..... 440/89 J
6,955,335 B2 * 10/2005 Kawai et al. ..... 251/129.11
6,978,755 B2 * 12/2005 Yamamoto et al. .... 123/184.49
6,997,157 B2 * 2/2006 Ikuma et al. ..... 123/184.53
7,011,065 B2 * 3/2006 Lang ..... 123/184.24
7,011,072 B2 * 3/2006 Nicholas ..... 123/336
7,032,579 B2 * 4/2006 Nishida et al. ..... 123/568.17
RE39,257 E * 9/2006 Kamimura et al. ..... 123/300
7,100,559 B2 * 9/2006 Uchiyama ..... 123/184.38
7,114,477 B2 * 10/2006 Shin ..... 123/184.47
2007/0017467 A1 * 1/2007 Letoumeau ..... 123/184.21

* cited by examiner

*Primary Examiner*—Stephen K. Cronin
*Assistant Examiner*—Katrina B. Harris
(74) *Attorney, Agent, or Firm*—Carlson, Gaskey & Olds

(57) ABSTRACT

An intake manifold assembly includes a housing, a shaft assembly, and an intake insert. The shaft assembly has a metal shaft with bearings located at each end to provide hard mounting surfaces for the shaft assembly when assembled in the housing. The bearings support the shaft within the housing and allow the shaft to freely rotate. Bushings are spaced along the shaft to absorb vibrations and assist is providing a low friction surface for shaft assembly rotation. Journal pockets in the housing and in the intake insert surround the bushings. Isolators located within the journal pockets and housing surround the bushings and assist in dampening vibrations.

17 Claims, 4 Drawing Sheets

INTAKE MANIFOLD WITH LOW CHATTER SHAFT SYSTEM

BACKGROUND OF THE INVENTION

This invention relates to a mounting arrangement for a shaft assembly within an intake manifold. More particularly, this invention relates to a shaft mounting arrangement that reduces noise and vibration of the shaft and assembly components.

Intake manifolds control the amount of air entering internal combustion engines and use shaft and blade assemblies to control the intake of air through to the engine.

The shafts have commonly been manufactured from plastic and coated with rubber to lower vibration and noise. However, plastic shafts have lower durability and strength. During manufacture, imperfections may occur in the shaft, other assembly components, and the manifold housing. The imperfections in the shaft assembly and manifold housing may cause misalignment of the shaft when assembled into the intake manifold housing. During operation of the vehicle the misalignment of the shaft assembly may cause non-circular rotation of the shaft assembly that creates noise. In addition, an imperfect fit between the shaft and manifold housing may cause the shaft to vibrate against the manifold housing during engine operation that also creates noise.

Because the shaft must be free to rotate within the manifold housing any components used for limiting vibration must be low friction to not hamper shaft rotation.

An arrangement for shaft assemblies in intake manifolds to reduce vibration noise during engine operation is needed.

SUMMARY OF THE INVENTION

An intake manifold assembly includes a housing, a shaft assembly, an intake insert, and a flange seal.

The shaft assembly may be a shaft manufactured from metal. Bearings located at each end provide hard mounting surfaces for the shaft assembly when assembled with the housing. The bearings support the shaft within the housing and allow the shaft to freely rotate. Load is applied on the bearings to hold the shaft assembly rigid within the housing. The bearings are low friction and assist in correcting any non-circular rotation of the shaft that may results from imperfect manufacturing. Supports on the intake insert at least partially surround the bearings once assembled and apply load to the bearings to retain the shaft within the housing.

Bushings are spaced along the shaft. The bushings are preferably two-part bushings with rubber seals and plastic sleeves. The rubber seals absorb vibrations and the plastic sleeves assist is providing a low friction surface for shaft assembly rotation. Journal pockets in the housing and in the intake insert surround the bushings. Isolators located within the journal pockets surround the bushings and assist in dampening vibrations.

These and other features of the present invention can be best understood from the following specification and drawings, the following of which is a brief description.

DETAILED DESCRIPTION OF THE PREFERRED EMBODIMENT

Figure 1:
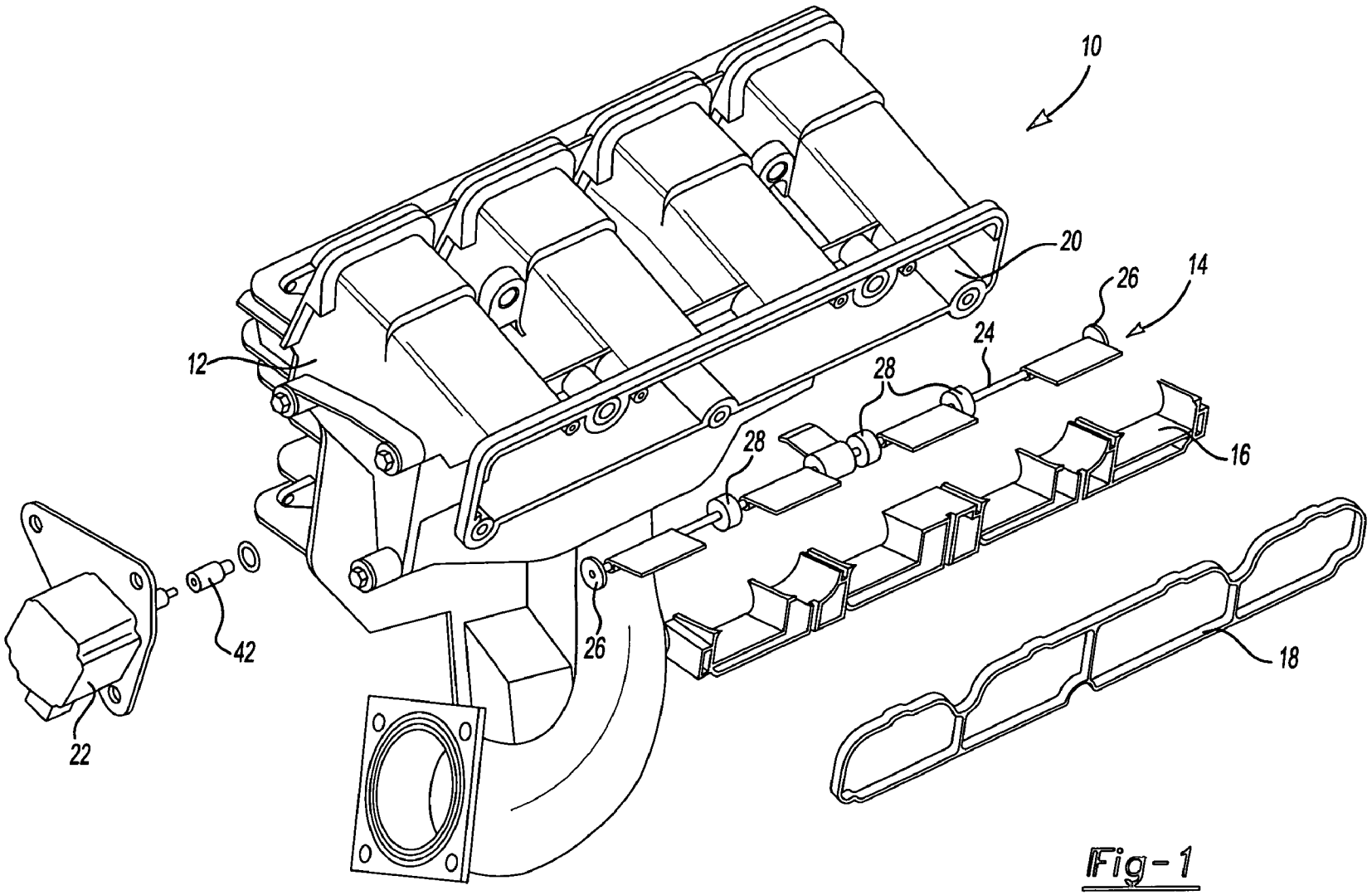
FIG. 1 is an exploded view of an intake manifold housing and intake shaft assembly.

FIG. 1 shows an intake manifold assembly 10. The intake manifold assembly 10 includes a housing 12, a shaft assembly 14, an intake insert 16, and a flange seal 18. The shaft assembly 14 is assembled into opening 20 within the housing 12. The intake insert 16 is placed within the opening 20 to retain and support the shaft assembly 14. The flange seal 18 is assembled last. The flange seal 18 seals around the opening 20 once the intake manifold assembly 10 is mounted to the engine. Bolts or other fasteners may be used to retain the shaft assembly 14 within the housing 12 until the intake manifold assembly 10 can be mounted to the engine. Once mounted to the engine, the shaft assembly 14 is held in place by the engine. An actuator 22 is mounted on the housing 12. Following assembly, actuator 22 is connected to the shaft assembly 14. During operation of the engine, the actuator 22 controls airflow through the main passage of the intake manifold assembly 10 by rotating the shaft assembly 14, as known.

Figure 2:
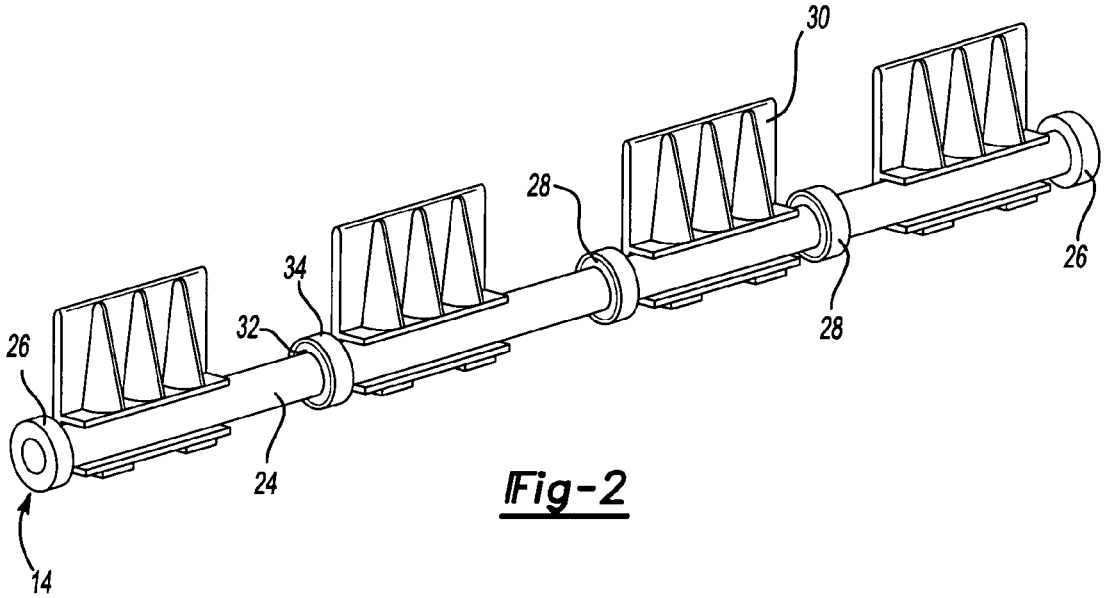
FIG. 2 is a perspective view of an intake shaft assembly.

FIG. 2 shows a perspective view of the shaft assembly 14. The shaft assembly 14 includes a shaft 24 with bearings 26 located at each end. The shaft 24 is preferably manufactured from metal. Bushings 28 are spaced along the shaft 24. The shaft 24 supports blades 30 for controlling airflow within the intake manifold assembly 10.

Figure 3:
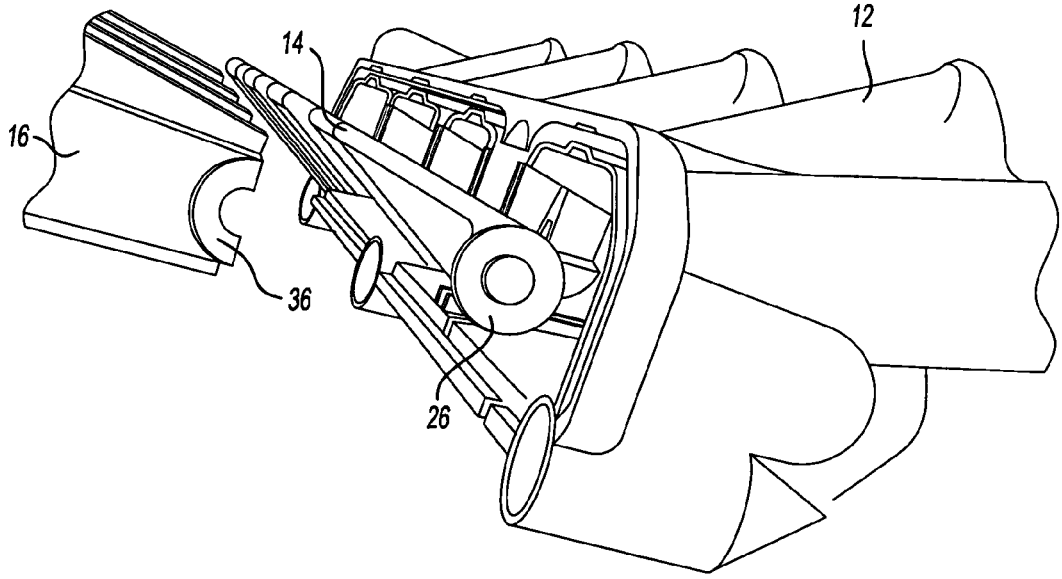
FIG. 3 is an exploded end view of the housing, shaft assembly, and intake insert.

Referring to FIG. 3, an exploded end view of housing 12, shaft assembly 14, and intake insert 16 is shown. The bearings 26 provide hard mounting surfaces for the shaft assembly 14 when assembled with the housing 12. Load is applied from the housing 12 on the bearings 26 once the intake manifold assembly 10 is mounted to the engine. The fasteners retaining the engine and the intake manifold assembly 10 are tightened. Tightening the fasteners results in the intake manifold housing 12 and intake insert 16 being pressed together. Load is applied to the bearings 26 by the intake manifold housing 12 and the intake insert 16 because the bearings 26 are situated between the intake manifold housing 12 and the intake insert 16. The load holds the shaft assembly 14 rigid within the housing 12. Therefore, the bearings 26 set the position of the shaft assembly 14 within the housing 12. The bearings 26 are low in friction and assist in correcting any non-circular rotation of the shaft assembly 14 that may results from imperfect manufacturing.

Figure 4:
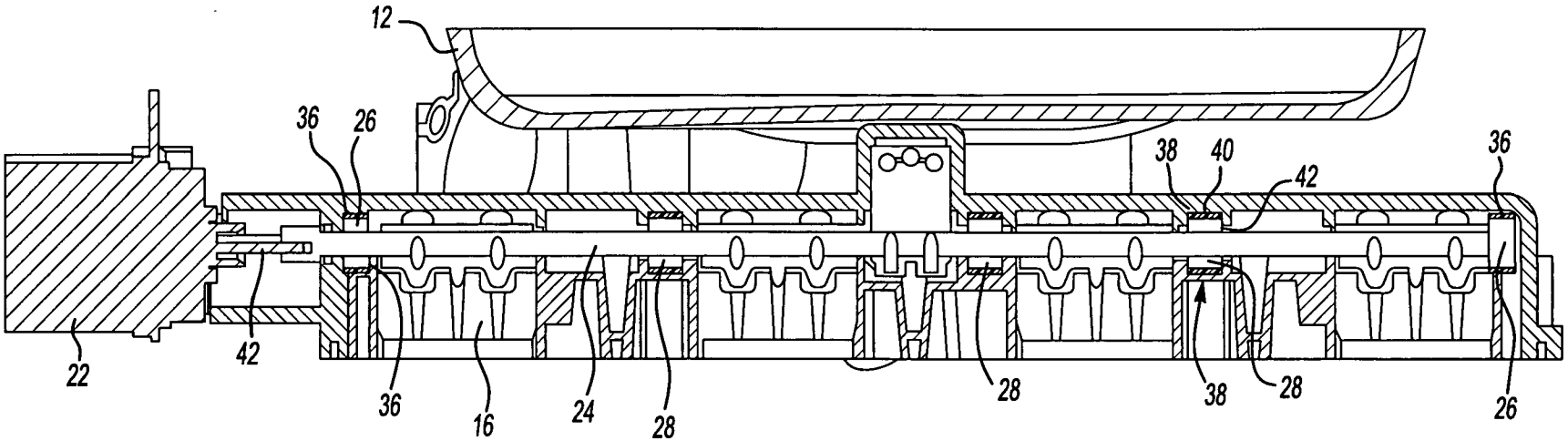
FIG. 4 is an end view of the assembled intake manifold and the shaft assembly.

FIG. 4 shows an end view of the intake manifold assembly 10. Supports 36 on the intake insert 16 and corresponding supports within the housing 12 at least partially surround the bearings 26 once assembled. The supports 36 apply load to the bearings 26 to retain the shaft 24 within the housing 12. In addition, journal pockets 38 in the housing 12 and in the intake insert 16 at least partially surround the bushings 28. However, the journal pockets do not place a load on the bushings.

Figure 5:
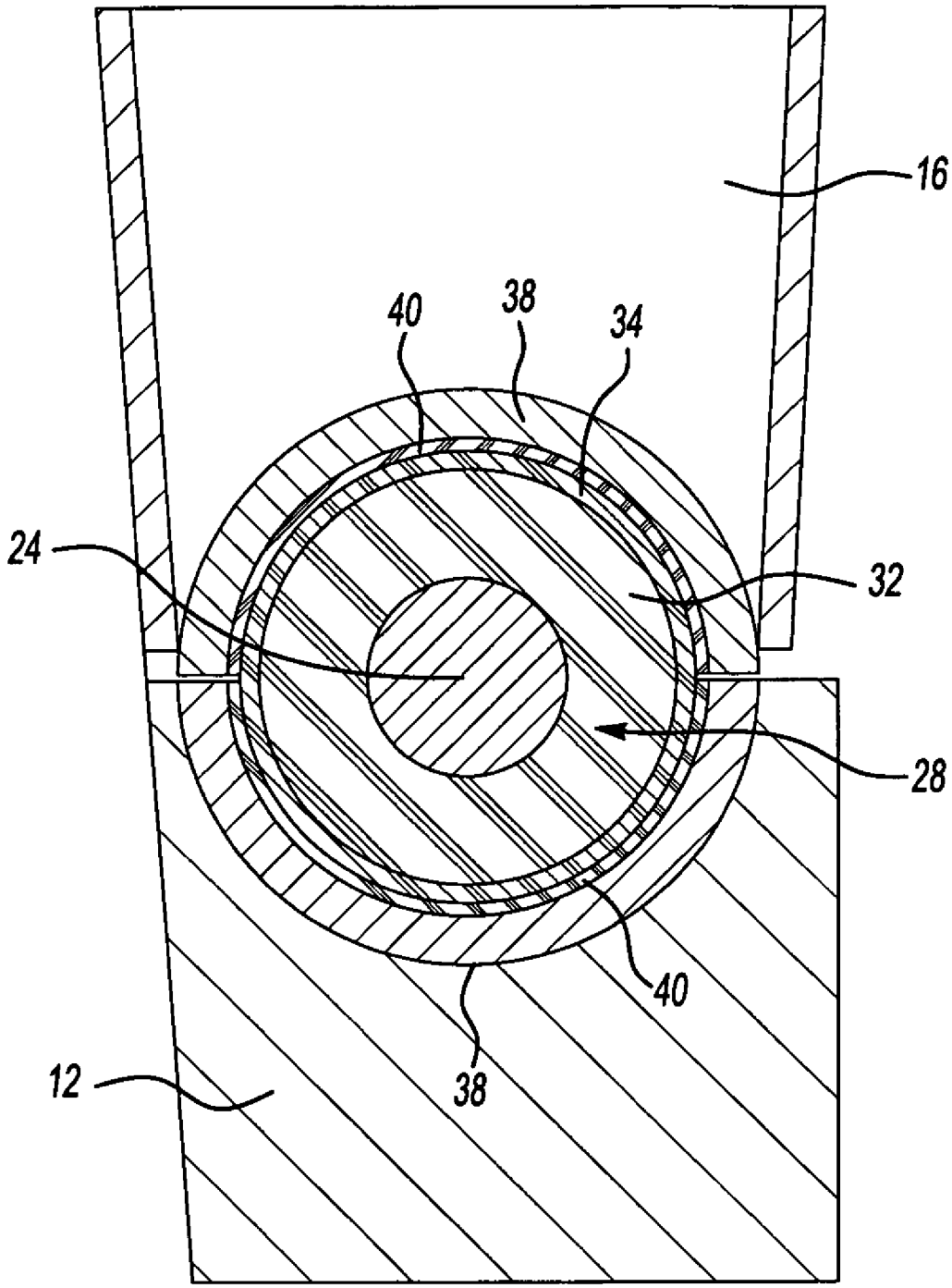
FIG. 5 is a cross-sectional view of the bushing, housing and insert when assembled.

FIG. 5 shows a cross-section of the bushings 28 assembled within the housing 12. The bushings 28 are preferably two-part bushings with rubber seals 32 and plastic sleeves 34. In addition to sealing, the rubber seals 32 absorb vibrations from between the shaft assembly 14 and the housing 12. The plastic sleeves 34 provide a low friction surface for shaft assembly 14 rotation within the housing 12. The bushings 28 are soft mounts because load is not applied to the exterior surface of the bushings 28. Journal pockets 38 in the housing 12 and in the intake insert 16 at least partially surround the bushings 28. Isolators 40 located within the journal pockets 38 and housing 12 surround the bushings 28 and assist in dampening vibrations. The isolators 40 are preferably fabricated from an elastomeric material.

Referring back to FIG. 1, the shaft 24 is connected to the actuator 22 through an actuator shaft 42. During operation, the actuator 22 rotates the shaft 24. The bearings 26 support the shaft 24 within the housing 12 and allow the shaft 24 to freely rotate. The bushings 28 absorb vibrations created during operation to reduce noise created by the intake manifold assembly 10. The mountings for the actuator 22 are manufactured from the same mold as the housing to reduce manufacturing variations among the parts and lowering the resultant vibrations. The intake insert 16 provides support for the shaft assembly 14 through bearings 26, and bushings 28. The intake insert 16 also secures the shaft assembly 14 within the housing 12.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An intake manifold assembly comprising:

a shaft having a bearing assembly secured to each end of said shaft;

at least one bushing supported on said shaft between said bearing assemblies, wherein said bushing includes a pliable seal surrounding said shaft and a sleeve disposed around said pliable seal; and at least one isolator supported in a journal pocket of an intake manifold housing, said at least one isolator at least partially surrounding said at least one bushing.

2. The intake manifold assembly of claim 1, wherein said shaft is retained within said intake manifold housing by load applied to said bearing assemblies.

3. The intake manifold assembly of claim 1, wherein said at least one isolator comprises an elastomeric material.

4. The intake manifold assembly of claim 1, including at least three of said at least one isolator and at least three of said at least one bushing.

5. The intake manifold assembly of claim 1, wherein said a pliable seal comprises a rubber seal and said sleeve comprises a plastic sleeve that includes a hardness greater than said pliable seal.

6. The intake manifold assembly of claim 1, wherein said shaft comprises a metal material.

7. The intake manifold assembly of claim 1, including an intake insert mounted within said intake manifold, wherein said intake insert defines a portion of said journal pocket including a portion of at least one isolator partially surrounding the at least one bushing.

8. An intake manifold assembly comprising:

a shaft retained within an intake manifold housing by load applied to bearing assemblies secured to each end of said shaft;

at least one bushing supported on said shaft between said bearing assemblies, said bushing including a pliable seal surrounding said shaft and a sleeve enclosing said pliable seal; and at least one isolator supported in a journal pocket of said intake manifold housing, said at least one isolator at least partially surrounding the at least one bushing.

9. The intake manifold assembly of claim 8, wherein said at least one isolator comprises an elastomeric material.

10. The intake manifold assembly of claim 8, including at least three of said at least one isolator and at least three of said at least one bushing.

11. The intake manifold assembly of claim 8, wherein said pliable seal comprises a rubber material and said shell comprises a plastic material with a hardness greater than said rubber material.

12. The intake manifold assembly of claim 8, wherein said shaft is fabricated from a metal material.

13. The intake manifold assembly of claim 8, including an intake insert mounted within said intake manifold for retaining said shaft, said intake insert defining a portion of each of said journal pockets and supporting at least one isolator within said journal pocket that at least partially surrounds each of said at least one bushing.

14. An intake manifold assembly comprising:

an intake housing and an intake insert defining a first journal pocket, a second journal pocket and a third journal pocket disposed between said first and second journal pockets;

a first bearing supported within said first journal pocket, and a second bearing supported within said second journal pocket;

a shaft supported for rotation by said first bearing and said second bearing; and a bushing assembly surrounding said shaft and supported within said third journal pocket, said bushing assembly includes a pliable seal surrounding said shaft and a sleeve surrounding said pliable seal.

15. The intake manifold assembly as recited in claim 14, wherein said third journal pocket includes an isolator at least partially surrounding said bushing assembly.

16. The intake manifold assembly as recited in claim 15, wherein said isolator comprises a pliable material for absorbing at least some vibration of said shaft.

17. The intake manifold assembly as recited in claim 14, wherein said sleeve comprises a plastic material that is harder than said pliable seal.

* * * * *